US006575814B1

(12) United States Patent
Ayyagari et al.

(10) Patent No.: US 6,575,814 B1
(45) Date of Patent: Jun. 10, 2003

(54) DRY POLISHING OF INTRAOCULAR LENSES

(75) Inventors: Madhu Ayyagari, Fairport, NY (US); Mahendra P. Nandu, Rochester, NY (US)

(73) Assignee: Bausch & Lomb Incorporated, Rochester, NY (US)

( * ) Notice: Subject to any disclaimer, the term of this patent is extended or adjusted under 35 U.S.C. 154(b) by 153 days.

(21) Appl. No.: 09/642,349

(22) Filed: Aug. 21, 2000

(51) Int. Cl.[7] ..... B25B 1/00

(52) U.S. Cl. ..... 451/35; 451/32; 451/326; 451/328; 451/41

(58) Field of Search ..... 451/41, 42, 32, 451/35, 36, 38, 39, 33, 34, 43, 44, 75, 87, 91, 326, 328

(56) References Cited

U.S. PATENT DOCUMENTS

| | | | | |
|---|---|---|---|---|
| 2,084,427 A | | 6/1937 | Broderson | |
| 2,380,653 A | | 7/1945 | Kopplin | |
| 2,387,034 A | | 10/1945 | Milano | |
| 3,030,746 A | | 4/1962 | Firestine et al. | |
| 4,485,061 A | | 11/1984 | Akhavi et al. | |
| 4,541,206 A | | 9/1985 | Akhavi | |
| 4,580,371 A | | 4/1986 | Akhavi | |
| 5,009,731 A | * | 4/1991 | Yoshikawa et al. | 451/42 |
| 5,133,159 A | | 7/1992 | Nelson | |
| 5,571,558 A | | 11/1996 | Nguyen et al. | |
| 5,649,988 A | | 7/1997 | Valle et al. | |
| 5,725,811 A | | 3/1998 | Nguyen et al. | |
| 5,961,370 A | * | 10/1999 | Valle et al. | 451/32 |
| 6,010,391 A | * | 1/2000 | Lewellen et al. | 451/35 |
| 6,186,868 B1 | * | 2/2001 | Cremeans et al. | 451/32 |

FOREIGN PATENT DOCUMENTS

| | | |
|---|---|---|
| CH | 679 838 A5 | 4/1992 |
| EP | 0 215 261 | 3/1987 |
| EP | 0 494 305 A1 | 7/1992 |
| GB | 610947 | 10/1948 |
| GB | 1 428 005 | 3/1976 |
| JP | 04 250975 | 9/1992 |
| JP | 11 347914 | 12/1999 |
| RU | 1201108 | 12/1985 |
| RU | 1570883 | 6/1990 |
| RU | 1641589 | 4/1991 |
| RU | 1649757 | 6/1992 |
| WO | WO 93/06967 | 4/1993 |

OTHER PUBLICATIONS

Database WPI Section PQ, Week 199321 Derwent Publications Ltd., London GB XP002189738 Jun. 29, 1992.
Data WPI Section PQ, Week 199151, Dersent Publications Ltd, London GB XP002189739.
Database WPI Section PQ, Week 199107 Derwent Publication Ltd. London GB XP002189740.
Database WPI Section PQ, Week 198637 Derwent Publications Ltd, London GB XP002189741 Dec. 30, 1984.

* cited by examiner

*Primary Examiner*—Eileen P. Morgan
*Assistant Examiner*—Hadi Shakeri
(74) *Attorney, Agent, or Firm*—Rita D. Vacca

(57) ABSTRACT

A process of dry polishing molded or lathe cut intraocular lenses or like medical devices to removing flash, sharp edges and/or surface irregularities therefrom. The process includes gas and/or rotational tumbling of the intraocular lenses or like medical devices in a dry polishing media. The process is suitable for single piece and multipiece intraocular lenses of varying composition.

15 Claims, 10 Drawing Sheets

Hydroview IOLs - Dry Polish

| | control RMS roughness | | 2 days polished RMS roughness | | 4 days polished RMS roughness | |
|---|---|---|---|---|---|---|
| | optical | haptic | optical | haptic | optical | haptic |
| 1 | 10.256 | 4.385 | 29.447 | 7.894 | 25.53 | 7.41 |
| 2 | 13.603 | 3.991 | 35.53 | 9.63 | 26.379 | 7.139 |
| 3 | 9.021 | 9.228 | 30.169 | 5.965 | 23.953 | 9.95 |
| 4 | 14.169 | 5.169 | 31.406 | 6.011 | 34.543 | 38.136 |
| 5 | 11.361 | 6.69 | 27.94 | 8.433 | 31.79 | 51.588 |
| 6 | 14.647 | 6.679 | 33.41 | 6.04 | 33.549 | 6.396 |
| 7 | 9.42 | 10.265 | 27.376 | 11.401 | 30.185 | 45.595 |
| 8 | 9.591 | 11.48 | 29.938 | - | 30.902 | 40.866 |
| 9 | 9.844 | 9.404 | 27.504 | - | 29.084 | 52.389 |
| average | 11.3 | 7.5 | 30.3 | 7.9 | 29.5 | 28.8 |
| s.d. | 2.2 | 2.7 | 2.8 | 2.1 | 3.6 | 20.5 |

Contact Mode AFM image representative of a control (unpolished) Hydroview IOL lens. The optical region is shown on the left and the haptic is the image on the right

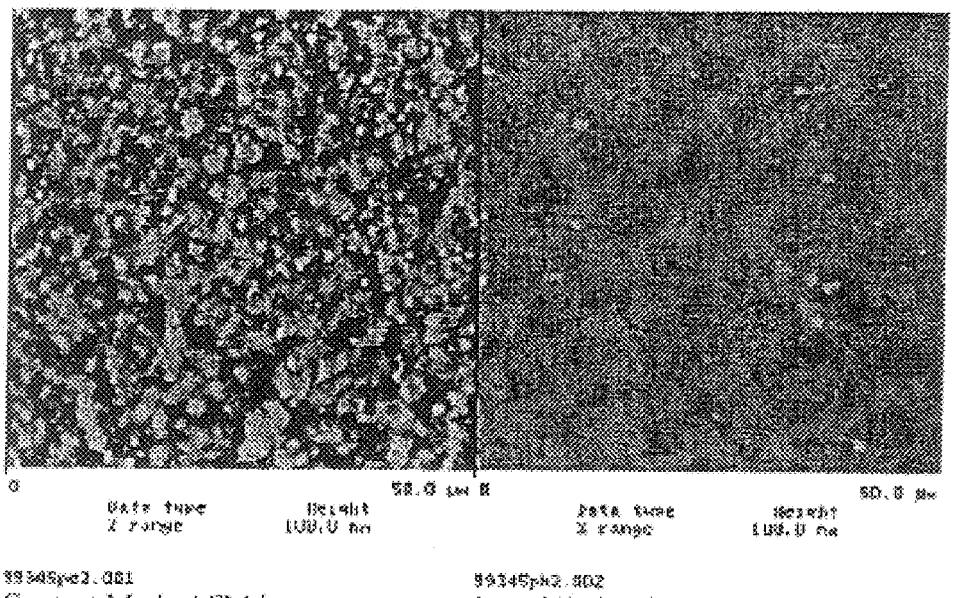

Contact Mode AFM image representative of Hydroview IOL lenses that were dry polished for two days with m11051 (pre-conditioned). The optical region is the image on the left and the haptic is the image on the right.

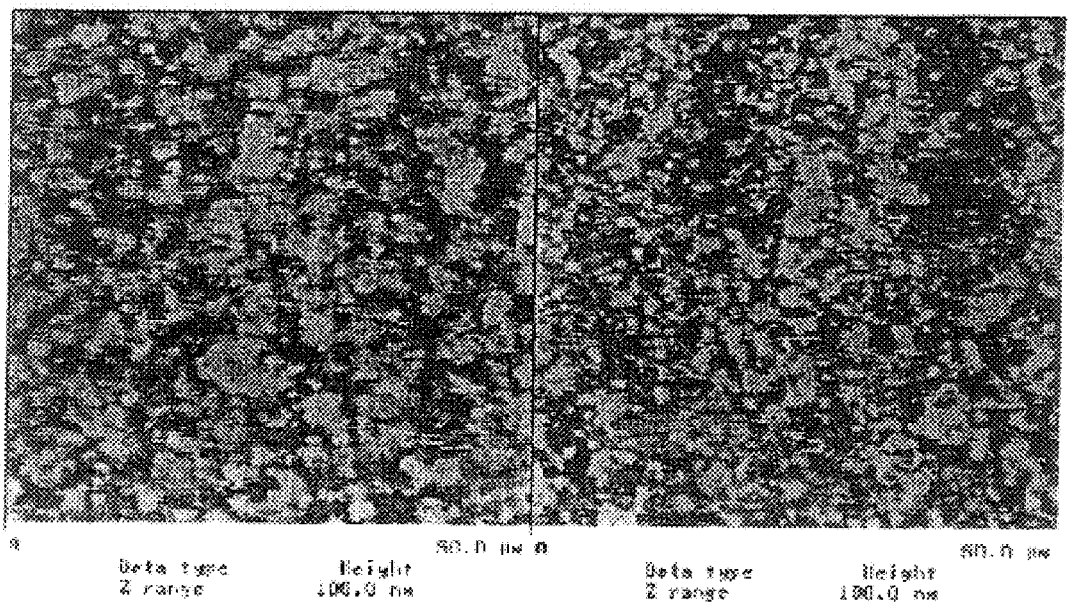

Contact Mode AFM image representative of Hydroview IOL lenses that were dry polished for four days with m11051 (pre-conditioned). The optical region is the image on the left and the haptic is the image on the right

FIG. 13

AFM images of dry polished IOLs

AFM images of dry polished IOLs

Edge sharpness of dry polished IOLs

DRY POLISHING OF INTRAOCULAR LENSES

FIELD OF THE INVENTION

The present invention relates to methods of polishing intraocular lenses. More specifically, the present invention relates to methods of dry polishing intraocular lenses in a fluidized bed of particles to remove flash, surface irregularities and/or sharp edges from molded or lathe cut surfaces thereof.

BACKGROUND OF THE INVENTION

Methods of molding articles from moldable materials have been known for some time. A common problem associated with molding techniques is the formation of excess material or flash on the edges of the molded article. Depending on the type of article formed in the molding process and the manner in which the article is used, the presence of excess material or flash can be undesirable. The same is also true of rough, irregular or sharp edges found on articles produced through a lathing process.

Many medical devices, such as for example intraocular lens implants, require highly polished surfaces free of sharp edges or surface irregularities. In the case of intraocular lenses (lOLs), the lens is in direct contact with delicate eye tissues. Any rough or non-smooth surface on an IOL may cause irritation or abrading of tissue or other similar trauma to the eye. It has been found that even small irregularities can cause irritation to delicate eye tissues.

Various methods of polishing are known in the art. U.S. Pat. Nos. 2,084,427 and 2,387,034 disclose methods of making plastic articles such as buttons that include tumbling the articles to remove projections of excess material or flash.

U.S. Pat. No. 2,380,653 discloses a cold temperature tumbling process to remove flash from a molded article. This method requires the article to be tumbled in a rotatable container of dry ice and small objects such as wooden pegs. The cold temperature resulting from the dry ice renders the flash material relatively brittle, such that the flash is more easily broken from the article during the tumbling process.

U.S. Pat. No. 3,030,746 discloses a grinding and polishing method for optical glass, including glass lenses. The method includes tumbling the glass articles in a composition of liquid, abrasive and small pellets or media. The liquid is disclosed as being water, glycerins, kerosene, light mineral oil and other organic liquids either alone or in combination. The abrasive component is described as being garnet, corundum, boron carbide, cortz, aluminum oxide, emery or silicon carbide. The media is disclosed as being ceramic cones, plastic slugs, plastic molding, powder, limestone, synthetic aluminum oxide chips, maple shoe pegs, soft steel diagonals, felt, leather, corn cobs, cork or waxes.

U.S. Pat. No. 4,485,061 discloses a method of processing plastic filaments which includes abrasive tumbling to remove excess material.

U.S. Pat. Nos. 4,541,206 and 4,580,371 disclose a lens holder or fixture used for holding a lens in a process of rounding the edge thereof. The process includes an abrasive tumbling step.

U.S. Pat. No. 5,133,159 discloses a method of tumble polishing silicone articles in a receptacle charged with a mixture of non-abrasive polishing beads and a solvent which is agitated to remove surface irregularities from the articles.

U.S. Pat. No. 5,571,558 discloses a tumbling process for removing flash from a molded IOL by applying a layer of aluminum oxide on a plurality of beads, placing the coated beads, alcohol, water and silicone lOLs in a container and tumbling the same to remove flash.

U.S. Pat. No. 5,725,811 discloses a process for removing flash from molded lOLs including tumbling the lOLs in a tumbling media of 0.5 mm diameter glass beads and 1.0 mm diameter glass beads, alcohol and water.

Prior methods of removing flash or surface irregularities, such as described above, may be inadequate or impractical in the manufacture of certain types of lOLs. For example, certain lOLs formed from relatively soft, highly flexible material, such as silicone, are susceptible to chemical and/or physical changes when subjected to cold temperatures. For this reason, certain types of cryo-tumbling or cold temperature tumbling may be impractical in the manufacture of lOLs made from such materials. Additionally, certain types of abrasive tumbling processes may be suitable for harder lens material, such as glass or polymethylmethacrylate (PMMA), but may not be suitable for softer lens materials. Also, most tumbling processes known in the art require the lens to be submersed in a liquid that may not be suitable for some lens materials or manufacturing processes. Accordingly, a need exists for a suitable process for removing flash and/or irregularities from molded or lathe cut lOLs made of various materials.

SUMMARY OF THE INVENTION

The present invention relates to methods for dry polishing lOLs. IOLs are currently either molded in removable molds or lathe cut. Subsequent to these operations, the lOLs have surface roughness or sharp edges that need to be minimized or eliminated. After polishing methods such as tumbling the lOLs in a container with glass beads and a liquid, the lOLs must be dried or in the case of hydrogels dehydrated, prior to further processing. Drying or dehydrating the lOLs can be both expensive and time consuming. The dry polishing methods of the present invention eliminate the need for drying or dehydrating lOLs. This is particularly important in the case of surface coated lOLs where a coating or surface treatment can not be consistently applied in the presence of moisture.

The first method of dry polishing lOLs in accordance with the present invention consists of obtaining a polishing chamber having two opposed open ends, placing glass-spun wool in each open end and polishing material and lOLs in the center. Air, or any other inert gas or gases, is then passed into one end of the polishing chamber and out of the other end while the length of the polishing chamber is preferably maintained in a vertical position. The flow of air keeps the lOLs and polishing material buoyant resulting in dry polished lOLs. After polishing the lOLs, the lOLs are removed from the polishing chamber and polishing material with the use of a sieve. The lOLs are then easily handled and surface treated at this stage without having to dry the same.

The second and third methods of dry polishing lOLs in accordance with the present invention consist of obtaining an IOL container with one or more optic clamps or flexible optic loops extending from one or more but preferably one rigid arm members. One IOL is placed in each open hinged optic clamps or flexible optic loops of the IOL container so that the lOLs' haptics extend from slots formed in the optic clamps or flexible optic loops. In the case of the optic clamps, once an IOL is positioned therein, the open hinge of the optic clamp is snapped close to secure the IOL in place. The optic clamps when closed only contact the outer peripheral edges of the lOLs positioned therein. Alternatively, the flexible optic loops are designed such that one IOL snaps or slips into position within each flexible optic loop thereof leaving all but the IOL optic peripheral edges exposed. The IOL container with lOLs positioned therein is then snapped into place within a polishing chamber using retention means formed therein. The polishing chamber and the axially concentric IOL tube are then preferably maintained in a horizontal position. The retention means inside the polishing chamber removably fixes the IOL container within the polishing chamber to prevent rotation of the IOL container within the polishing chamber. A dry polishing medium is placed inside the polishing chamber and the one or more open ends thereof removably sealed. The polishing chamber is then axially rotated. As the polishing chamber is rotated, the polishing medium repeatedly contacts the exposed IOL surfaces thus polishing the same. The duration of tumbling and the revolutions per minute of the polishing chamber can be adjusted to achieve the desired degree of polishing. Since the slots of the IOL container protect the IOL optic peripheral edges, the IOL optic peripheral edges remain sharp while the remainder are polished. Following polishing, the lOLs are removed from the IOL container. The polished lOLs are then easily handled and surface treated without having to dehydrate or dry the same.

The fourth method of dry polishing lOLs in accordance with the present invention involves placing lOLs and dry polishing medium within a polishing chamber so that the lOLs are evenly dispersed throughout. The polishing chamber is then removably sealed and placed on a tumbler and tumbled at a specified speed for a specified period of time. As the polishing chamber tumbles, the dry polishing medium repeatedly contacts the IOL surfaces thereby polishing the same.

Accordingly, it is an object of the present invention to provide a method for dry polishing lathe cut lOLs.

Another object of the present invention is to provide a method for dry polishing molded lOLs.

Another object of the present invention is to provide a method for polishing IOLs without the use of liquids.

Another object of the present invention is to provide a method for polishing lOLs that eliminates the need to dry or dehydrate the same prior to further processing.

Another object of the present invention is to provide a method for dry polishing lOLs that is suitable for a variety of IOL materials.

Still another object of the present invention is to provide a method for polishing lOLs that allows for consistent surface coating without additional process steps.

These and other objectives and advantages of the present invention, some of which are specifically described and others that are not, will become apparent from the detailed description, drawings and claims that follow, wherein like features are designated by like numerals.

BRIEF DESCRIPTION OF THE DRAWINGS

FIGS. 12 and 13 are charts indicating the results from lOLs produced per Example 1.

DETAILED DESCRIPTION OF THE INVENTION

Figure 1:
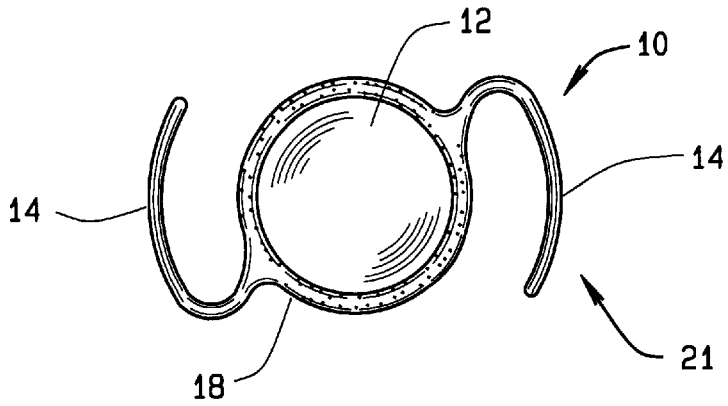
FIG. 1 is a plan view of an intraocular lens with open haptics.
Figure 2:
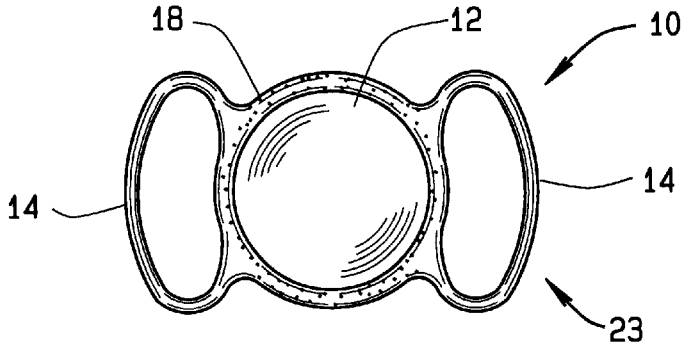
FIG. 2 is a plan view of an intraocular lens with looped haptics.

FIGS. 1 and 2 illustrate typical intraocular lenses (lOLs) 10 produced using dry polishing methods of the present invention. Each IOL 10 typically has an optic portion 12 defined by an outer peripheral edge 18 and one or more but typically two to four haptics 14 of either an open configuration 21 as illustrated in FIG. 1 or a looped configuration 23 as illustrated in FIG. 2. The haptics 14 are integrally formed on outer peripheral edge 18 or permanently attached thereto through processes such as heat, physical staking and/or chemical bonding. The typical IOL 10 may be made from a variety of materials such as but not limited to polymethylmethacrylate (PMMA), silicones, hydrophilic acrylics, hydrophobic acrylics or combinations thereof.

Figure 3:
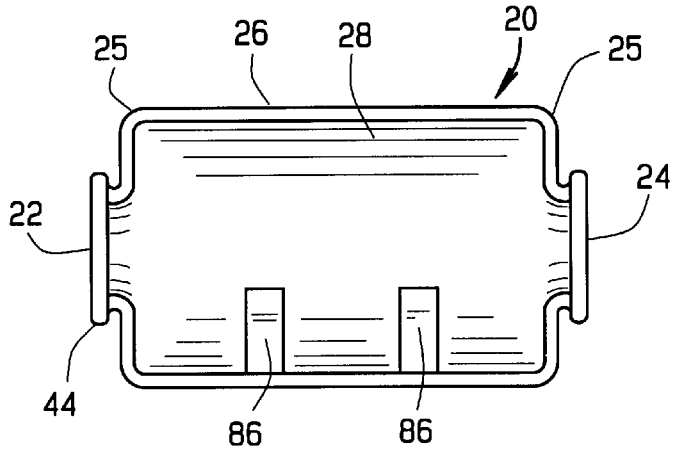
FIG. 3 is a plan view of a polishing chamber of the present invention.
Figure 4:
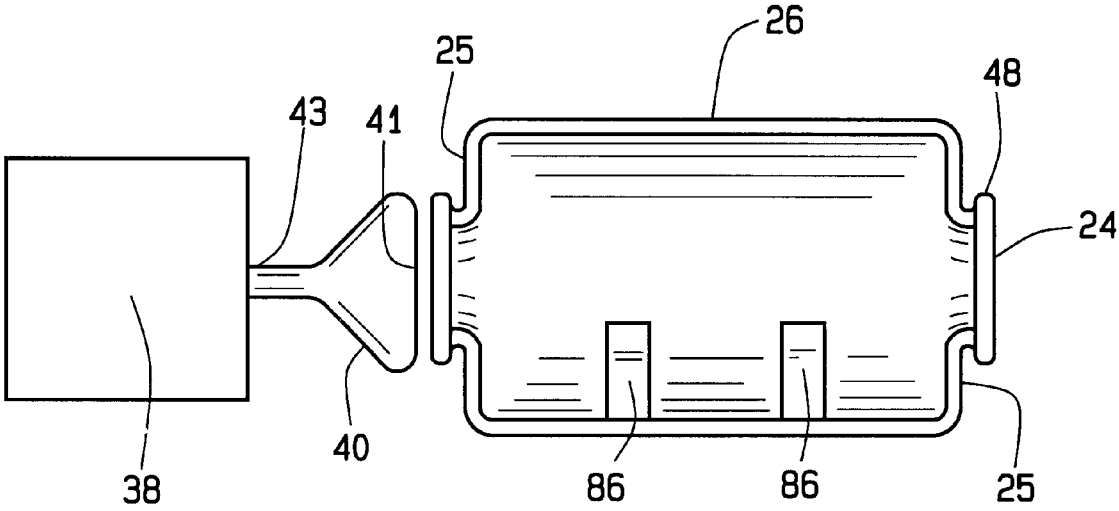
FIG. 4 is a plan view of the polishing chamber of FIG. 3 connected to an air source.

FIG. 3 illustrates a polishing chamber 20, which may be made of any suitable material such as but not limited to glass, plastic, metal or a combination thereof but preferably, glass for visibility and cleaning ease. Polishing chamber 20 may be of any geometric configuration defining an interior area 28 and having one or more depending on the polishing method selected, but preferably two openings 22 and 24 therein for ease in cleaning the same. Preferably, polishing chamber 20 is of a tubular configuration defined by a tubular body 26 having two opposed open ends 22 and 24. Tubular body 26 may optionally decrease in diameter abruptly to form partial end walls 25 at one or both open ends 22 and/or 24 for increased structural integrity. Open end 22 is defined by an extended rim 44. As illustrated in FIG. 4, extended rim 44 is suitable for removable attachment, by various methods known to those skilled in the art, to end 41 of tubing 40. Suitable methods of attachment include but are not limited to friction fit, male and female threaded means, snap fit interlocking means and tab and groove interlocking means whereby snap fit interlocking means is preferred for ease of assembly and strength of the removable attachment. Optionally, a perforated cap or frit 46 may be snap fit onto extended rim 44 prior to attachment of end 41 of tubing 40. Removably attached to opposed end 43 of tubing 40 by attachment methods such as those discussed above, but preferably by snap fit interlocking means, is a gas source 38 of air or any other inert gas or gases.

Figure 5:
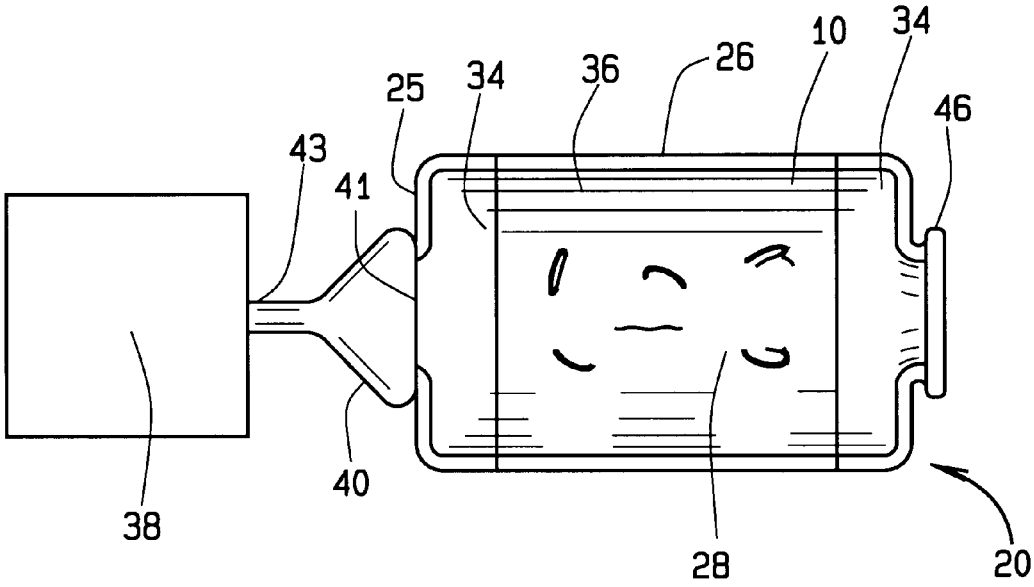
FIG. 5 is a plan view of the polishing chamber of FIG. 4 after loading.

After attaching gas source 38 to polishing chamber 20 using tubing 40, a retaining material 34 is placed in interior area 28 at open end 22 as best illustrated in FIG. 5. Suitable retaining material 34 includes but is not limited to glass-spun wool, cotton, wool, and other natural or synthetic fiber materials of like density, but preferably glass-spun wool to avoid air borne fiber contamination within the manufacturing facility. After placing retaining material 34 in interior area 28, polishing media 36 and lOLs 10 are loaded within interior area 28. Suitable polishing media 36 includes but is not limited to glass beads, silica gel, silica and aluminum oxide whereby silicone and aluminum oxide is preferred due to ready availability at low cost. After the polishing media 36 and lOLs 10 are placed within polishing chamber 20, retaining material 34 is placed in interior area 28 to fill the same at open end 24. A perforated cap or frit 46 is then removably attached in accordance with methods discussed above to extended rim 48 of open end 24. It is preferred that frit 46 is removably attached by snap fit interlocking means to extended rim 48 for ease of use. Once assembled as described, the length of polishing chamber 20 is preferably vertically positioned and gas source 38 is activated to provide a flow of one or more inert gases such as for example but not limited to air through polishing chamber 20 to polish lOLs 10 placed therein. Preferably the one or more inert gases are forced through said polishing chamber at a rate of approximately 1 to 6 cubic feet per minute. After an adequate amount of time to polish lOLs 10, preferably approximately 2 to 60 hours but most preferably approximately 12 to 48 hours, frit 46 is removed from extended rim 48 and retaining material 34 is removed from interior area 28. Polishing media 36 and lOLs 10 may then be poured from polishing chamber 20 into an appropriately sized sieve to separate the polished lOLs 10 from polishing media 36.

Figure 7:
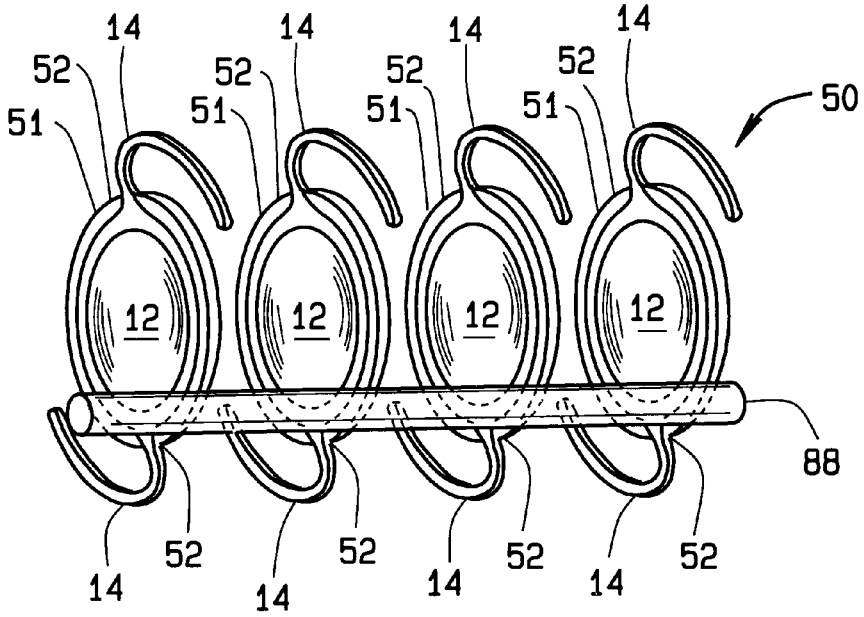
FIG. 7 is a perspective view of the IOL container of FIG. 6 with lOLs loaded therein.
Figure 6:
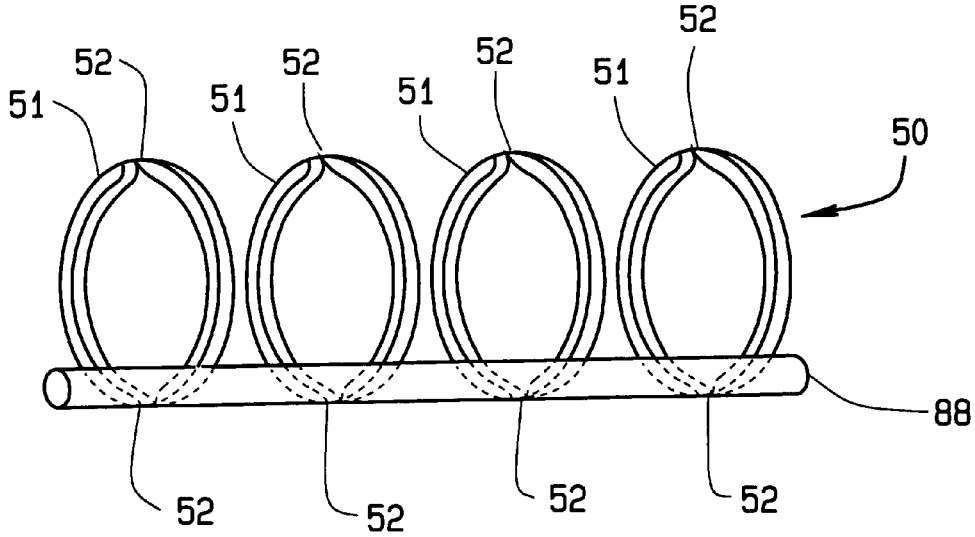
FIG. 6 is a perspective view of the IOL container of the present invention.
Figure 8:
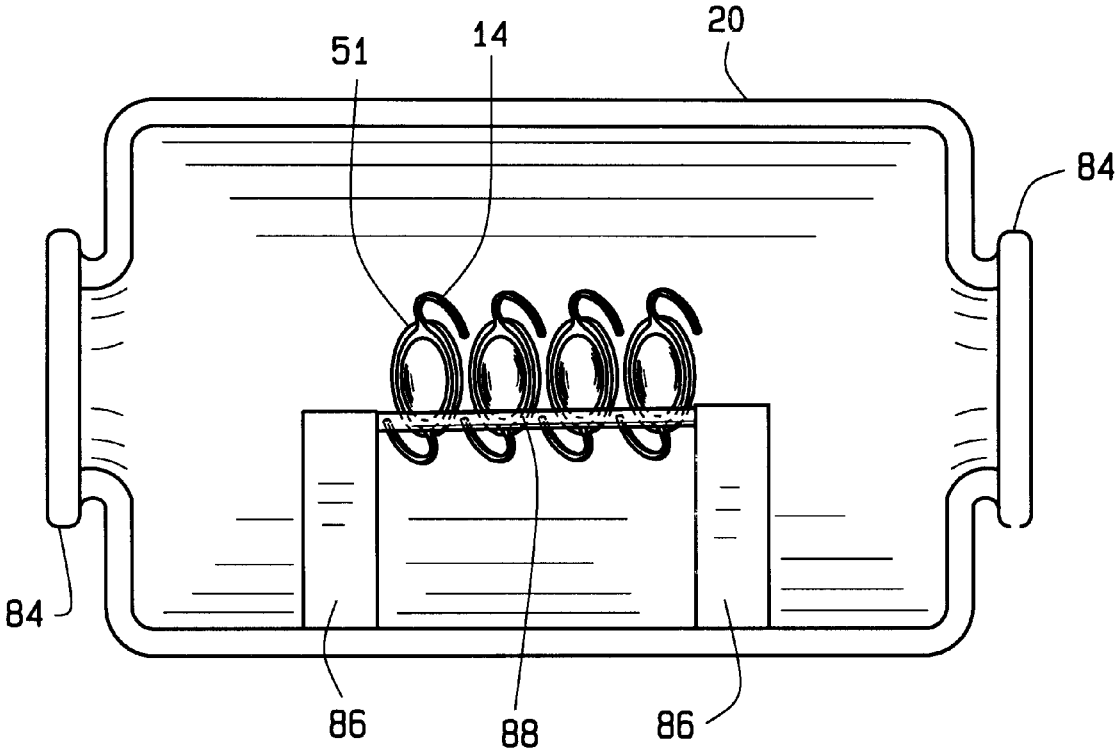
FIG. 8 is a plan view of the polishing chamber of FIG. 3 with the IOL container of FIG. 7 removably fixed therein.

Another method of dry polishing lOLs 10 in accordance with the present invention to produce more defined peripheral edges 18 on optic portion 12 is likewise provided. More defined outer peripheral edges 18 are desirable to reduce or prevent posterior capsular opacification of lOLs 10 after implantation thereof within an eye. The subject dry polishing method utilizes an IOL container 50 as illustrated in FIGS. 6 and 7. IOL container 50 may be made of any suitable material such as but not limited to glass, plastic, natural or synthetic rubber, metal or a combination thereof but preferably a combination of glass or rigid plastic and flexible plastic or rubber for function and durability. IOL container 50 is preferably of an elongated shape with one or more but preferably numerous flexible optic loops 51. Preferably IOL container 50 is formed by one or more but preferably one rigid arm member 88 with numerous flexible optic loops formed therewith or attached thereto. Flexible optic loops 51 are formed with slots 52 to accommodate any number of haptics 14 on IOL 10. IOLs 10 are removably positioned and maintained by friction within flexible optic loops 51 as illustrated in FIG. 7. Haptics 14 of lOLs 10 extend from slots 52 in flexible optic loops 51 to allow polishing of the same. IOL container 50 may be fixed within polishing chamber 20 as illustrated in FIG. 8 by snapping rigid arm member 88 within retaining means 86. In accordance with this particular method, polishing chamber 20 may optionally have only one open end 22 rather than two open ends 22 and 24. If polishing chamber 20 has two open ends 22 and 24, one open end 22 is removably or permanently sealed by means discussed above with a cap 84. Interior area 28 is then loaded through open end 24 with polishing media 36. Suitable polishing media 36 includes but is not limited to glass beads, silica gel, silica and aluminum oxide whereby silicone and aluminum oxide is preferred due to ready availability at low cost. After filling polishing chamber 20 with polishing media 36, the second open end 24 is removably sealed by means discussed above with a cap 84. If polishing chamber 20 has only one open end 22, interior area 28 is loaded through open end 22 with polishing media 36. After filling polishing chamber 20 with polishing media 36, open end 22 is removably sealed by means discussed above with a cap 84. Polishing chamber 20 once filled with IOL container 50 and polishing media 36, is placed on a tumbler (not shown) to axially rotate the same as described in U.S. Pat. Nos. 5,571,558, 5,649,988 and 5,725,811 each incorporated herein in its entirety by reference. After allowing polishing chamber 20 to rotate at a specified speed, preferably 50 to 200 revolutions per minute but most preferably 100 revolutions per minute, and for a specified period of time, preferably 2 to 48 hours but most preferably 8 to 36 hours, polishing chamber 20 is removed from the tumbler. The tumbler speed and the duration of the tumbling will vary depending upon the material of IOL 10, the polishing media 36 selected and the degree of smoothness desired. A cap 84 is removed from polishing chamber 20 and polishing media 36 is removed therefrom. IOL container 50 may then be removed from polishing chamber 20 and polished lOLs 10 removed from flexible optic loops 51.

Figure 9:
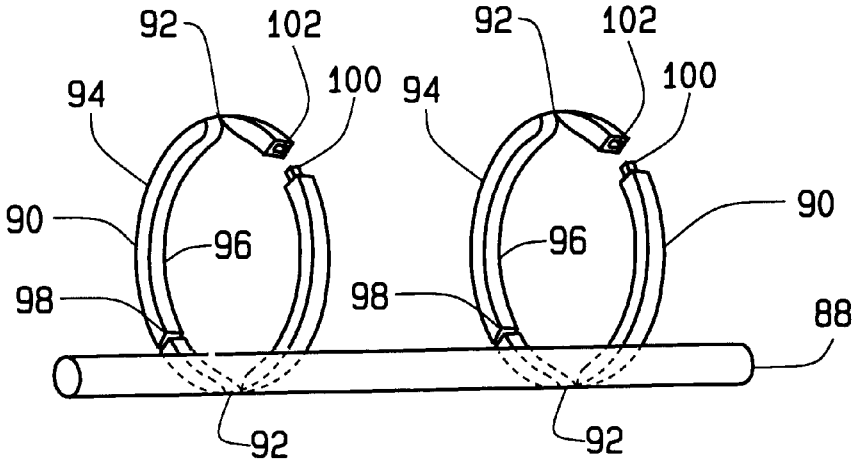
FIG. 9 is a perspective view of a second embodiment of the IOL container of the present invention.
Figure 10:
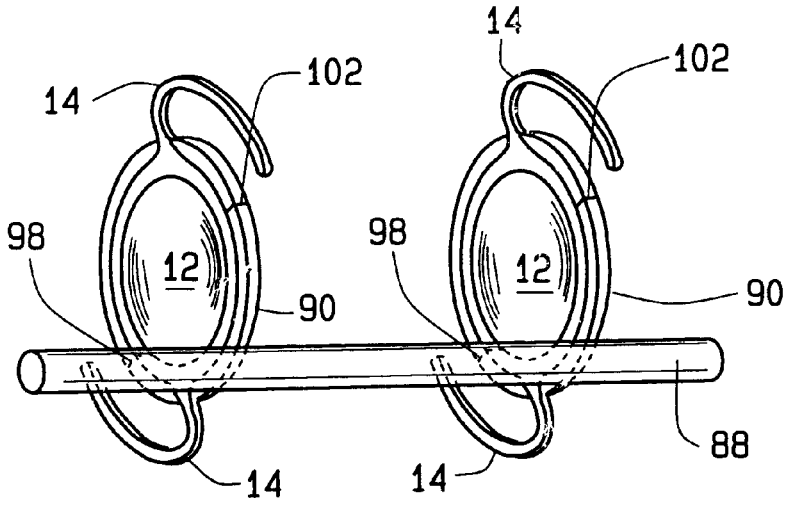
FIG. 10 is a perspective view of the IOL container of FIG. 9 with lOLs loaded therein.
Figure 11:
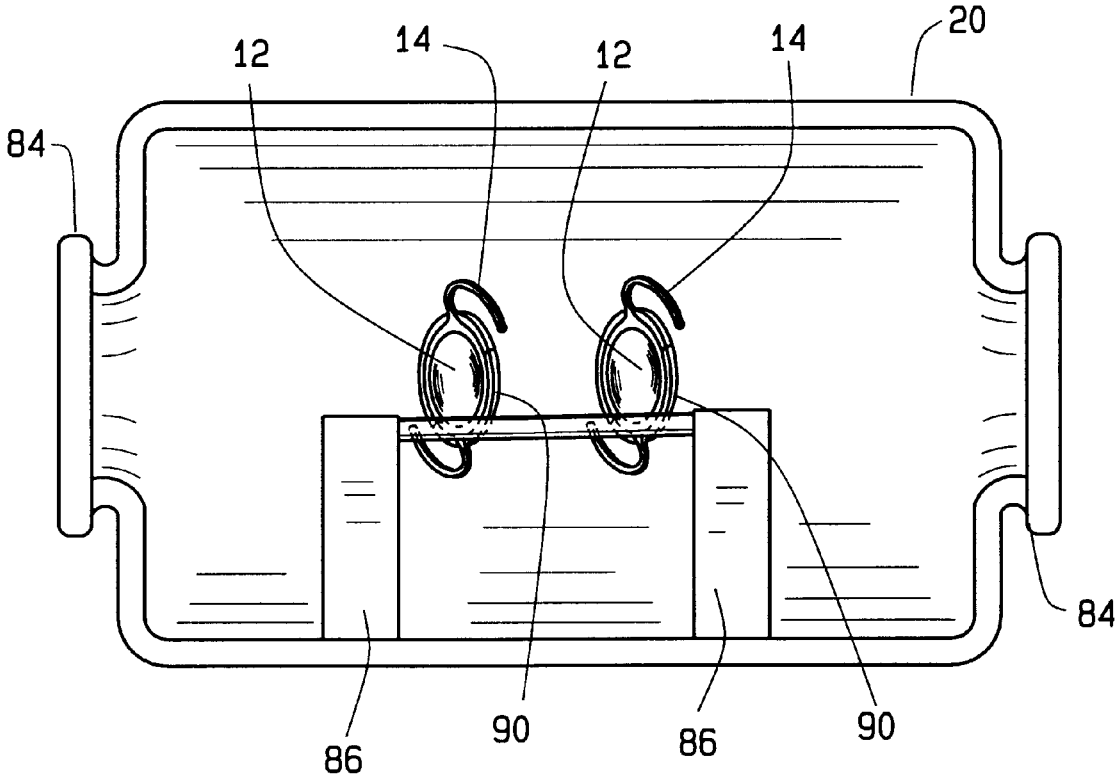
FIG. 11 is a plan view of the polishing chamber of FIG. 3 with the IOL container of FIG. 10 removably fixed therein.

Another method of dry polishing lOLs 10 in accordance with the present invention to produce more defined outer peripheral edges 18 on optic portion 12 in effort to reduce or prevent posterior capsular opacification of lOLs 10 after implantation within an eye utilizes an IOL container 80 as illustrated in FIGS. 9 and 10. IOL container 80 may be made of any suitable material such as but not limited to glass, plastic, natural or synthetic rubber, metal or a combination thereof but preferably a combination of glass or rigid plastic and flexible plastic or rubber for function and durability. IOL container 80 may be formed in any configuration that allows the haptics 14 and optic portions 12 of lOLs 10 to be exposed while protecting outer peripheral edge 18 from polishing. Preferably IOL container 80 is of an elongated form defined by one or more but preferably one rigid arm member 88. Rigid arm member 88 is equipped with one or more but preferably numerous optic clamps 90. Slots 92 are formed in optic clamps 90 to allow haptics 14 to extend through beyond the exterior 94 of optic clamps 90 when an IOL 10 is positioned within the interior 96 thereof. In order to allow for IOL 10 to be positioned within interior 96, each optic clamp 90 has a hinge 98, a tab 100 and a groove 102 for opening and securely closing optic clamp 90. To place IOL 10 within interior 96, optic clamp 90 is opened by removing tab 100 from groove 102 and thus opening hinge 98. IOL 10 is then positioned within the optic clamp 90 formed to specifically conform or match outer peripheral edge 18 with haptics 14 extending through slots 92. Optic clamp 90 is then securely closed by inserting tab 100 into groove 102 for removable attachment by snap fit interlocking means, thus closing hinge 98. IOL container 80 loaded with lOLs 10 is illustrated in FIG. 10. Haptics 14 of lOLs 10 extend from slots 92 in optic clamp 90 to allow polishing of the same. IOL container 80 may be fixed within polishing chamber 20 as illustrated in FIG. 11 by snapping rigid arm member 88 within retaining means 86. In accordance with this particular method, polishing chamber 20 may optionally have only one open end 22 rather than two open ends 22 and 24. If polishing chamber 20 has two open ends 22 and 24, one open end 22 is removably or permanently sealed by means discussed above with a cap 84. Interior area 28 is then loaded through open end 24 with polishing media 36. Suitable polishing media 36 includes but is not limited to glass beads, silica gel, silica and aluminum oxide whereby silicone and aluminum oxide is preferred due to ready availability at low cost. After filling polishing chamber 20 with polishing media 36, the second open end 24 is removably sealed by means discussed above with a cap 84. If polishing chamber 20 has only one open end 22, interior area 28 is loaded through open end 22 with polishing media 36. After filling polishing chamber 20 with polishing media 36, open end 22 is removably sealed by means discussed above with a cap 84. Polishing chamber 20 once filled with IOL container 80 and polishing media 36, is placed on a tumbler (not shown) to axially rotate the same as described above. After allowing polishing chamber 20 to rotate at a specified speed, preferably 50 to 200 revolutions per minute but most preferably 100 revolutions per minute, and for a specified period of time, preferably 2 to 48 hours but most preferably 8 to 36 hours, polishing chamber 20 is removed from the tumbler. The tumbler speed and the duration of the tumbling will vary depending upon the material of IOL 10, the polishing media 36 selected and the degree of smoothness desired. A cap 84 is removed from polishing chamber 20 and polishing media 36 is removed therefrom. IOL container 80 may then be removed from polishing chamber 20 and polished lOLs 10 removed from optic clamp 90.

Another method for dry polishing lOLs 10 in accordance with the present invention uses polishing chamber 20. In this particular method, polishing chamber 20 may optionally have only one open end 22 rather than two open ends 22 and 24. If polishing chamber 20 has two open ends 22 and 24, one open end 22 is removably or permanently sealed by means discussed above with a cap 84. Interior area 28 is then loaded through open end 24 with lOLs 10 and polishing media 36. Suitable polishing media 36 includes but is not limited to glass beads, silica gel, silica and aluminum oxide whereby silicone and aluminum oxide is preferred due to ready availability at low cost. After filling polishing chamber 20 with lOLs 10 and polishing media 36, the second open end 24 is removably sealed by means discussed above with a cap 84. If polishing chamber 20 has only one open end 22, interior area 28 is loaded through open end 22 with lOLs 10 and polishing media 36. After filling polishing chamber 20 with lOLs 10 and polishing media 36, open end 22 is removably sealed by means discussed above with a cap 84. Polishing chamber 20 once filled is placed on a tumbler (not shown) to axially rotate the same as described above. After allowing polishing chamber 20 to rotate at a specified speed, preferably 50 to 200 revolutions per minute but most preferably 100 revolutions per minute, and for a specified period of time, preferably 2 to 48 hours but most preferably 8 to 36 hours, polishing chamber 20 is removed from the tumbler. The tumbler speed and the duration of the tumbling will vary depending upon the material of IOL 10, the polishing media 36 selected and the degree of smoothness desired. Cap 84 is removed from polishing chamber 20 and lOLs 10 and polishing media 36 are removed from polishing chamber 20. IOLs 10 are separated from polishing media 36 using an appropriately sized sieve.

The methods for dry polishing lOLs of the present invention are described in still greater detail in the Examples that follow.

EXAMPLE 1

Dry Polishing of Silicone and Hydroview™ Intraocular Lenses

Figure 12:
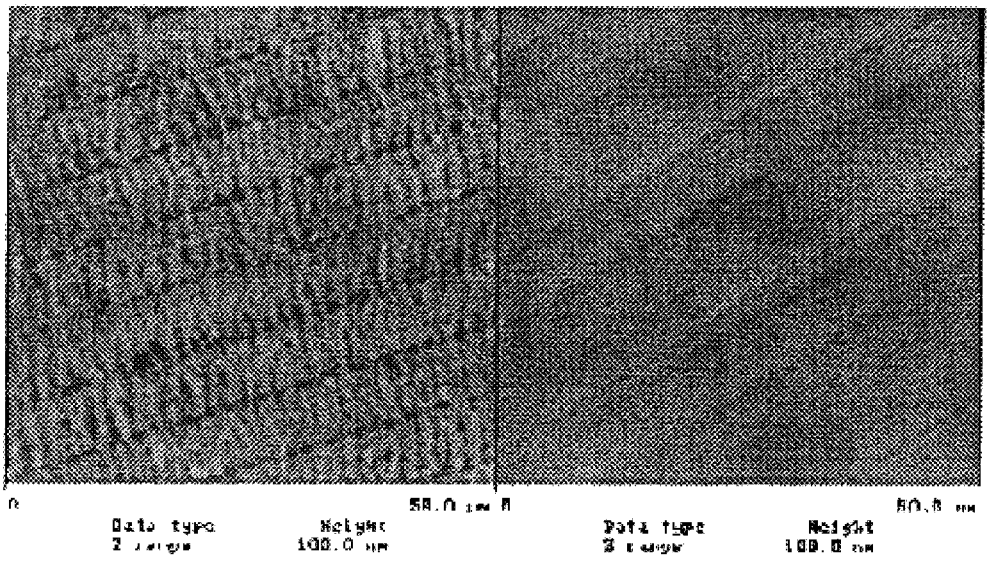

Ten silicone intraocular lenses and ten Hydroview intraocular lenses were obtained for dry polishing in accordance with the present invention. Hydroview lenses are bicomposite lenses having a hydrogel optic portion and polymethylmethacrylate haptics. Two glass polishing chambers tubular in form having a 2-inch internal diameter and 6 inches in length were obtained. One open end of one of the polishing chambers was capped with a plastic perforated cap or frit and the chamber was loaded with a glass spun wool plug in contact with the frit. Ten Hydroview lenses were then interspersed throughout approximately 20 gm of glass beads of 0.4 mm or less diameter and loaded onto the glass spun wool plug within the polishing chamber. Another glass spun wool plug was used to fill the remainder of the polishing chamber interior space prior to using a frit to cap the second polishing chamber opening. An air source was connected to the one of the frits using plastic tubing and a clamp and air flow was activated. The airflow was maintained at approximately 2 cubic feet per minute for approximately 48 hours. An air flow rate through the polishing chamber should be maintained at a level adequate to keep the lOLs buoyant and should be maintained for a period of time sufficient to achieve the desired level of IOL smoothness. IOL polishing occurs as the glass beads churned by the airflow bombard the lOLs. Additionally, one open end of the other polishing chamber was capped with a plastic perforated cap or frit and the chamber was loaded with a glass spun wool plug in contact with the frit. Ten silicone lenses were then interspersed throughout approximately 20 gm of glass beads of 0.4 mm or less diameter and loaded onto the glass spun wool plug within the polishing chamber. Another glass spun wool plug was used to fill the remainder of the polishing chamber interior space prior to using a frit to cap the second polishing chamber opening. An air source was connected to the one of the frits using plastic tubing and a clamp and airflow was activated. The airflow was maintained at approximately 4 cubic feet per minute for approximately 24 hours. An air flow rate through the polishing chamber should be maintained at a level adequate to keep the lOLs buoyant and should be maintained for a period of time sufficient to achieve the desired level of IOL smoothness. IOL polishing occurs as the glass beads churned by the airflow bombard the lOLs. The results from the lOLs so produced are set forth in FIGS. 12 and 13.

EXAMPLE 2

Dry Polishing of Hydroview Intraocular Lenses

Figure 14:
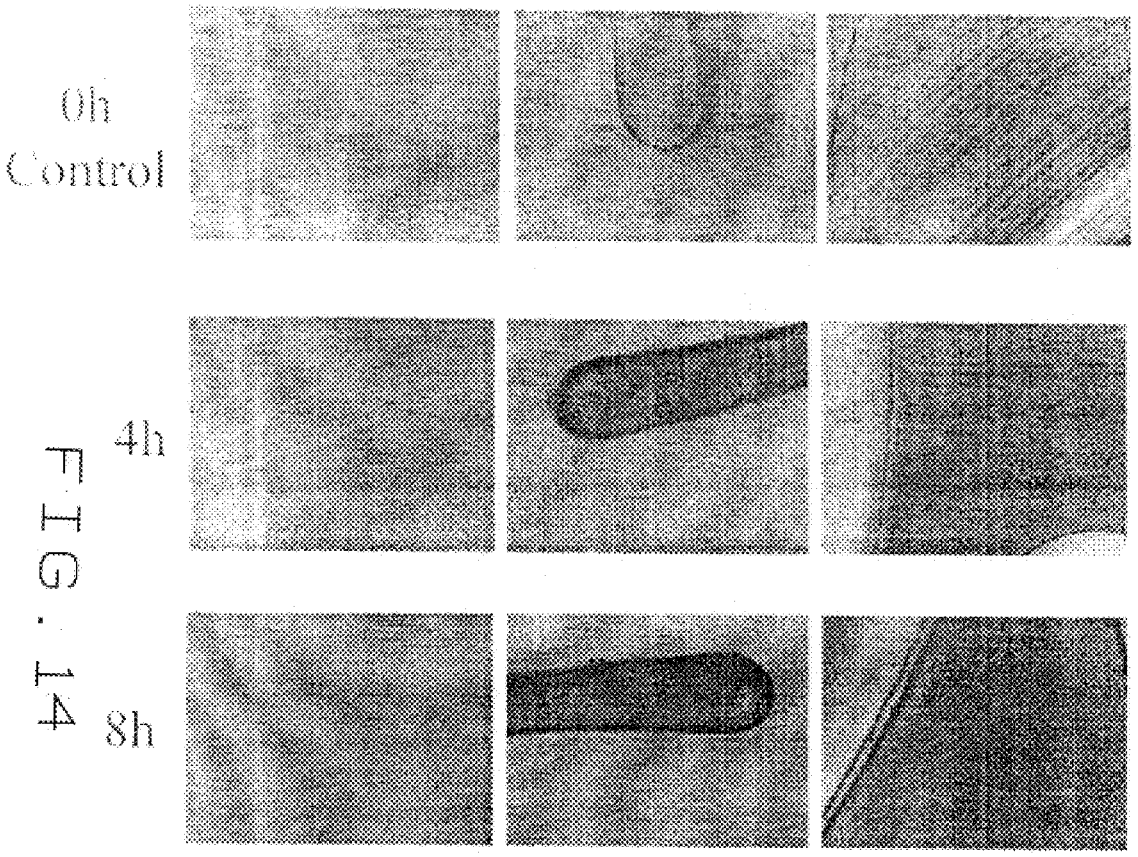
FIGS. 14 through 16 are results per Example 2.
Figure 15:
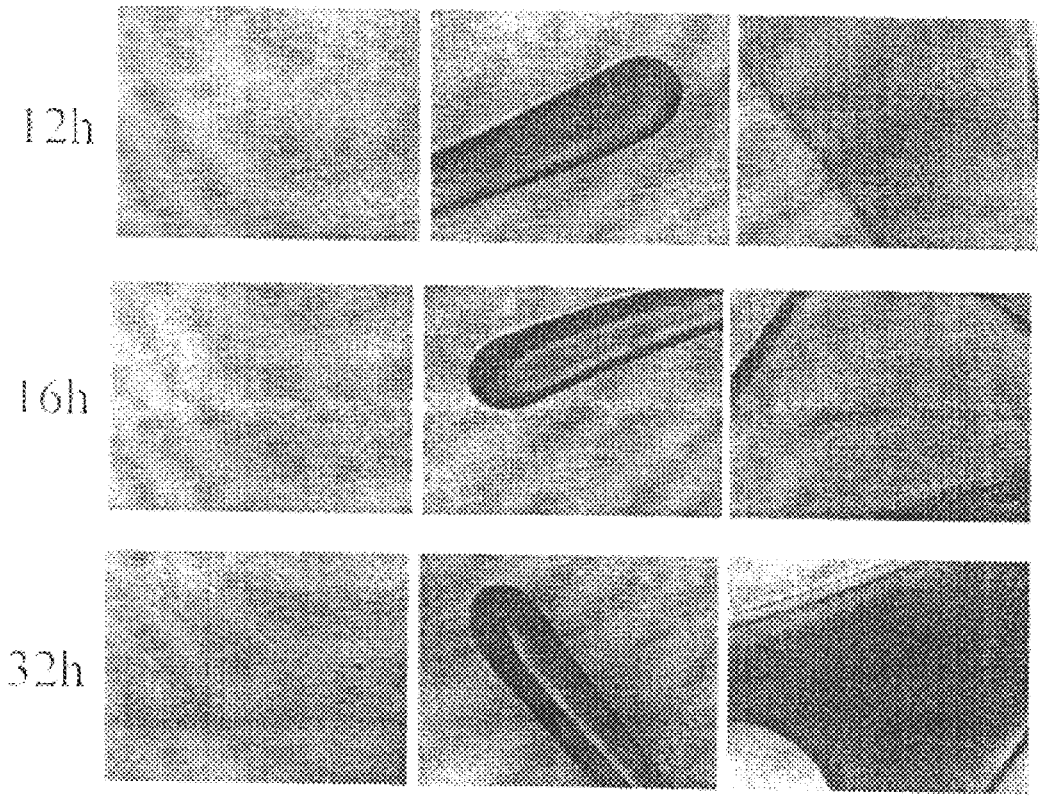
Figure 16:
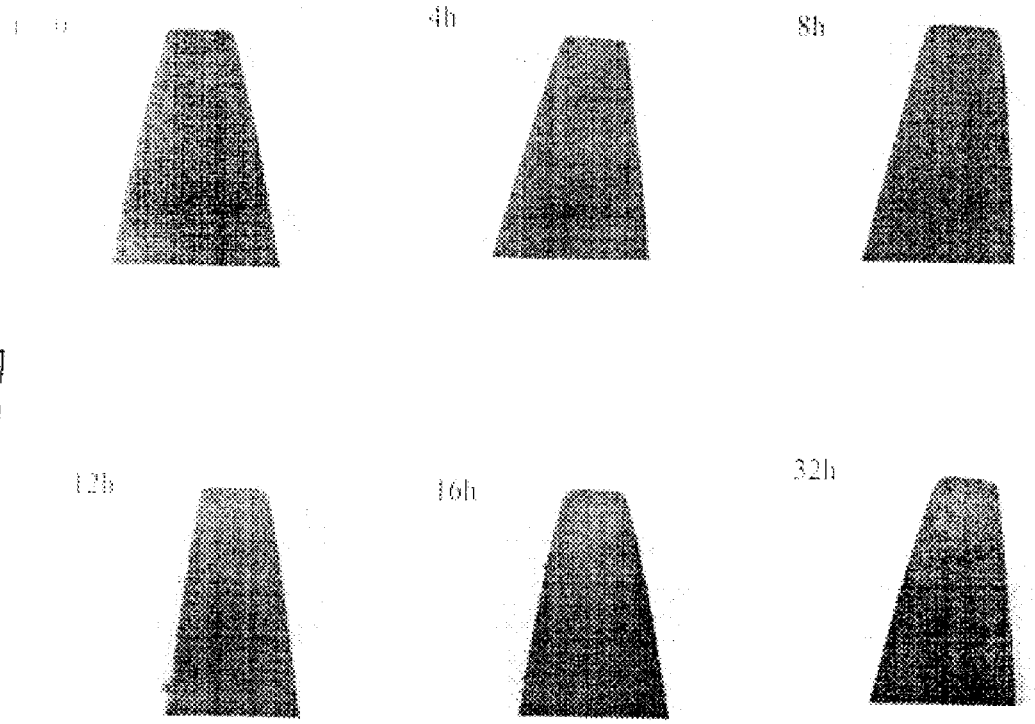

Twenty Hydroview intraocular lenses were obtained in accordance with the present invention. About 500 g of the polishing medium, a mixture of 0.5 mm and 0.1 mm glass beads, was placed in a clear glass bottle with a screw cap. The lOLs were loaded into the bottle with the polishing medium. The bottle was tightly capped and placed horizontally on a tumbler. The tumbler was set at 100 revolutions per minute for 36 hours. The lOLs were samples at the end of 2 hours, 4 hours, 8 hours, 12 hours, 16 hours and 32 hours. The sampled lOLs were analyzed for optic peripheral edge sharpness, haptic polishing and optic zone polishing using high magnification microscopes. The results are set forth in FIGS. 14, 15 and 16, wherein the 8-hour samples show that the desired polishing can be achieved while maintaining reasonable sharpness on the optic peripheral edges.

The methods of dry polishing lOLs as well as the lOLs produced thereby in accordance with the present invention provide a cost effective means by which multiple lOLs may be simultaneously polished without having to dry or dehydrate the same prior to further processing steps such as applying a consistent surface coating. Additionally, the methods of dry polishing lOLs of the present invention allows the manufacturer to polish an IOL's haptics while maintaining well defined edges on the optic portion thereof. This is and important feature to eliminate future posterior capsular opacification of the IOL after implantation.

While there is shown and described herein certain specific methods using specific equipment of the present invention, it will be manifest to those skilled in the art that various modifications may be made without departing from the spirit and scope of the underlying inventive concept and that the same is not limited to the particular forms herein shown and described except insofar as indicated by the scope of the appended claims.

We claim:

1. A method for dry polishing intraocular lenses comprising:

providing a polishing chamber with first and second openings;

securing said first opening with a perforated cap;

loading said polishing chamber with retaining material, dry polishing media and intraocular lenses;

securing said second opening with a perforated cap;

connecting a source of one or more inert gases to said first opening; and activating said source of one or more inert gases to force one or more inert gases through the polishing chamber and out said second opening to polish said intraocular lenses.

2. The method of claim 1 wherein said retaining material is selected from the group consisting of glass spun wool, cotton, wool, and other natural or synthetic fiber materials having similar density.

3. The method of claim 1 wherein said polishing media is selected from the group consisting of glass beads, silica gel, silica and aluminum oxide.

4. The method of claim 1 wherein said one or more gases is forced through said polishing chamber at a rate of approximately 1 to 6 cubic feet per minute.

5. The method of claim 1 wherein said one or more gases is forced through said polishing chamber at a rate of approximately 2 to 4 cubic feet per minute.

6. The method of claim 1 wherein said one or more gases is forced through said polishing chamber for a period of time of approximately 2 to 60 hours.

7. The method of claim 1 wherein said one or more gases is forced through said polishing chamber for a period of time of approximately 12 to 48 hours.

8. An intraocular lens dry polishing system comprising:

a polishing chamber with first and second openings;

first and second perforated caps to removably secure said first and second openings;

retaining material within an interior area of said polishing chamber in contact with said first and second perforated caps;

polishing media with intraocular lenses therein within an interior area of said polishing chamber between and in contact with said retaining material; and a source of one or more inert gases removably attached to said first perforated cap to pass one or more gases through said interior area of said polishing chamber and out of said polishing chamber through said second perforated cap.

9. The system of claim 8 wherein said retaining material is selected from the group consisting of glass spun wool, cotton, wool, and other natural or synthetic fiber materials having similar density.

10. The system of claim 8 wherein said polishing media is selected from the group consisting of glass beads, silica gel, silica and aluminum oxide.

11. The system of claim 8 wherein said one or more inert gases is forced through said polishing chamber at a rate of approximately 1 to 6 cubic feet per minute.

12. The system of claim 8 wherein said one or more inert gases is forced through said polishing chamber at a rate of approximately 2 to 4 cubic feet per minute.

13. The system of claim 8 wherein said one or more inert gases is forced through said polishing chamber for a period of time of approximately 2 to 60 hours.

14. The system of claim 8 wherein said one or more inert gases is forced through said polishing chamber for a period of time of approximately 12 to 48 hours.

15. An intraocular lens polished by a method of dry polishing comprising:

providing a polishing chamber with first and second openings;

securing said first opening with a perforated cap;

loading said polishing chamber with retaining material, dry polishing media and intraocular lenses;

securing said second opening with a perforated cap;

connecting a source of one or more inert gases to said first opening; and activating said source of one or more inert gases to force one or more inert gases through the polishing chamber and out said second opening to polish said intraocular lenses.

* * * * *